US006098791A

United States Patent [19]

Minnerop

[11] Patent Number: 6,098,791

[45] Date of Patent: Aug. 8, 2000

[54] SHIFTING DEVICE FOR ROLLING STOCK PLACED ON A ROLLER CONVEYOR

[75] Inventor: Michael Minnerop, Ratingen, Germany

[73] Assignee: SMS Schloemann-Siemag Aktiengesellschaft, Düsseldorf, Germany

[21] Appl. No.: 09/349,631

[22] Filed: Jul. 8, 1999

[30] Foreign Application Priority Data

Jul. 14, 1998 [DE] Germany ..... 198 31 479

[51] Int. Cl.[7] ..... B65G 21/20

[52] U.S. Cl. ..... 198/836.3; 198/597

[58] Field of Search ..... 198/836.1, 836.3, 198/597

[56] References Cited

U.S. PATENT DOCUMENTS 2,425,158 8/1947 Masich ..... 198/836.3 X
2,706,034 4/1955 Russell et al. ..... 198/836.3
5,636,127 6/1997 Aoki et al. ..... 198/836.3 X

FOREIGN PATENT DOCUMENTS 961797 10/1956 Germany .

*Primary Examiner*—James R. Bidwell
*Attorney, Agent, or Firm*—Friedrich Kueffner

[57] ABSTRACT

A shifting device for rolling stock placed on a roller conveyor includes a pair of linear shifting members which can be moved toward each other and away from each other transversely of the conveying direction of the roller conveyor and above the conveying plane of the roller conveyor, wherein the linear shifting members are each arranged on guide crossheads which are supported on rollers and are driven by drive devices arranged stationary outside of the roller conveyor so as to move the guide crossheads between and parallel to the rollers of the roller conveyor. The rollers supporting the guide crossheads are mounted in the two end portions of each guide crosshead and are guided on roller tables arranged on both sides of the conveying path of the roller conveyor and connected to the support frames of the roller conveyor.

7 Claims, 3 Drawing Sheets

SHIFTING DEVICE FOR ROLLING STOCK PLACED ON A ROLLER CONVEYOR

BACKGROUND OF THE INVENTION

1. Field of the Invention

The present invention relates to a shifting device for rolling stock placed on a roller conveyor. The shifting device includes a pair of linear shifting members which can be moved toward each other and away from each other transversely of the conveying direction of the roller conveyor and above the conveying plane of the roller conveyor, wherein the linear shifting members are each arranged on guide crossheads which are supported on rollers and are driven by drive devices arranged stationary outside of the roller conveyor so as to move the guide crossheads between and parallel to the rollers of the roller conveyor.

2. Description of the Related Art

In a shifting device of the above-described type disclosed in German Patent 961,797, the linear sliding members are provided with eccentric bushings which are placed in the linear sliding members, wherein the eccentric bushings are supported by vertical bolts which are rigidly connected to the guide crossheads. The guide crossheads are located underneath the rollers of the roller conveyor on a roll of support rollers which are supported in stationary crossbeams of the support frame of the roller conveyor. The guide crossheads are driven in pairs by longitudinal toothings of toothed gear motors arranged outside of the roller conveyor.

This known shifting device has the disadvantage that the structural weight of the guide crossheads is relatively high because of the long force transmission distances and require additional structural measures for the lateral guidance thereof. In addition, the drive units and the sliding distances of the guide crossheads with the lateral guide means thereof require a large amount of space outside of the roller conveyor and, moreover, the arrangement of the stationary crossbeams with the more or less high number of rollers which support the guide crossheads require additional space underneath the roller conveyor and the corresponding structural features. Even this shifting device is very complicated, the accuracy of the centering movements for the rolling stock which can be achieved with this shifting device is frequently not satisfactory.

SUMMARY OF THE INVENTION

Therefore, it is the primary object of the present invention to provide a shifting device of the above-described type in which the disadvantages mentioned above are eliminated and which has a light structural weight and requires less space and provides an exact centering control of the linear guide members.

In accordance with the present invention, the rollers supporting the guide crossheads are mounted in the two end portions of each guide crosshead and are guided on roller tables arranged on both sides of the conveying path of the roller conveyor and connected to the support frames of the roller conveyor.

In accordance with another feature of the present invention, the drive device for the linear guide members may be composed of positionally controllable pushing piston units which are arranged laterally of the conveying path of the roller conveyor, are placed on the support frames of the roller conveyor and are hinged to the rear sides of the linear sliding members.

In this embodiment of the shifting device, each guide crosshead constitutes a bridge which can be moved with rollers on the rollers of the roller conveyor back and forth underneath of the conveying plane and on both sides of the roller conveyor, wherein the drive of the bridge is effected by a direct short articulated connection between the pushing piston unit and the linear shifting member.

In addition, the guide crossheads may have between their two end portions a box-shaped reinforcement section. Also, in a conventional arrangement of the guide crossheads in pairs parallel next to each other for each of the two linear guide members, the end portions of the rollers supporting the guide crossheads may be composed of a pair of rollers which are arranged on both sides of the guide crossheads and are guided on pairs of rollers extending parallel to the guide crossheads, and of a vertical roller mounted underneath the guide crosshead and guided in roller tables. In accordance with the invention, the roller tables guiding the rollers can be arranged in pairs horizontally above or below or on both sides of the roller in a closed rectangular box. The rectangular box may be configured to be placeable and screwable to the support member of the roller conveyor. In addition, it is possible in accordance with the present invention to screw the linear sliding members in a fixed/loose bearing connection on shearing bolts placed in the guide crosshead. In accordance with another feature, the support frame of the roller conveyor can be mounted together with the guide crossheads, the linear sliding members and the drives thereof on a vertical lifting device.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
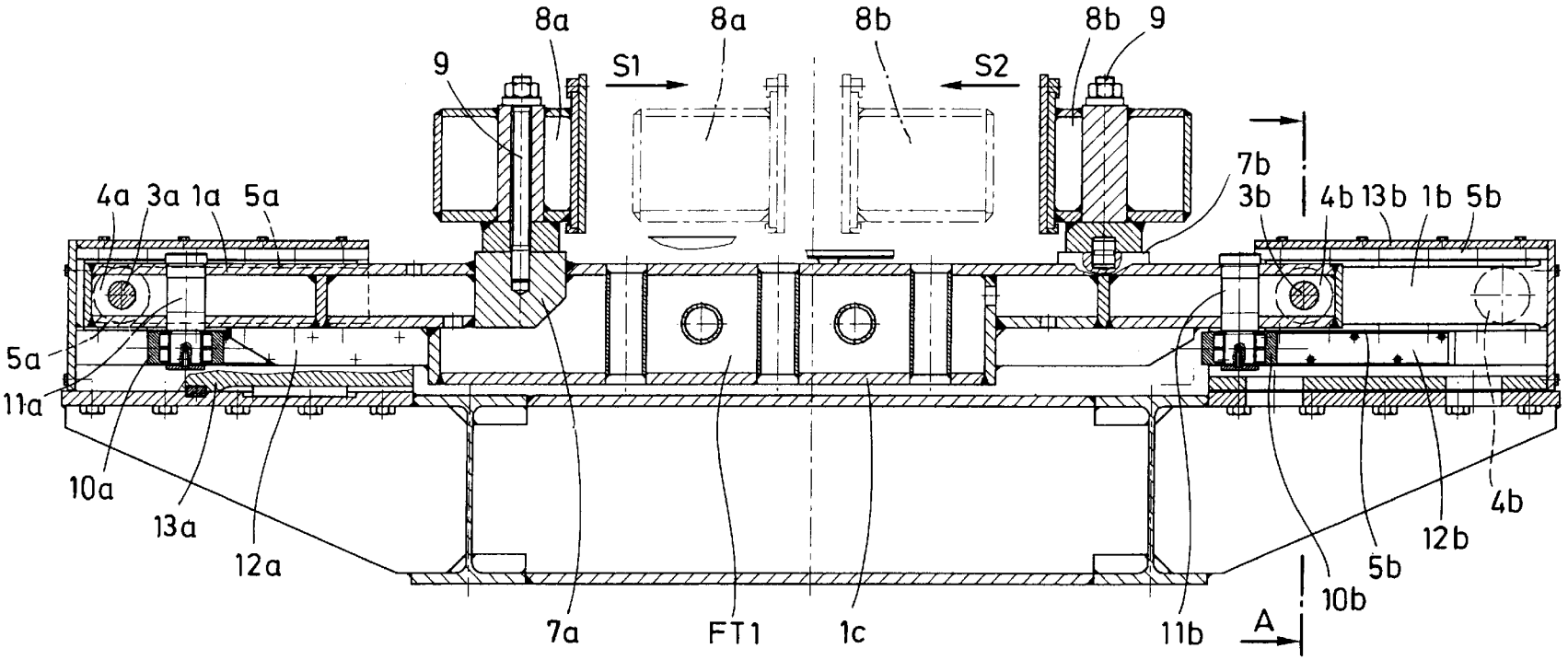
FIG. 1 is a sectional view of the shifting device as seen in the conveying direction of the roller conveyor.
Figure 3:
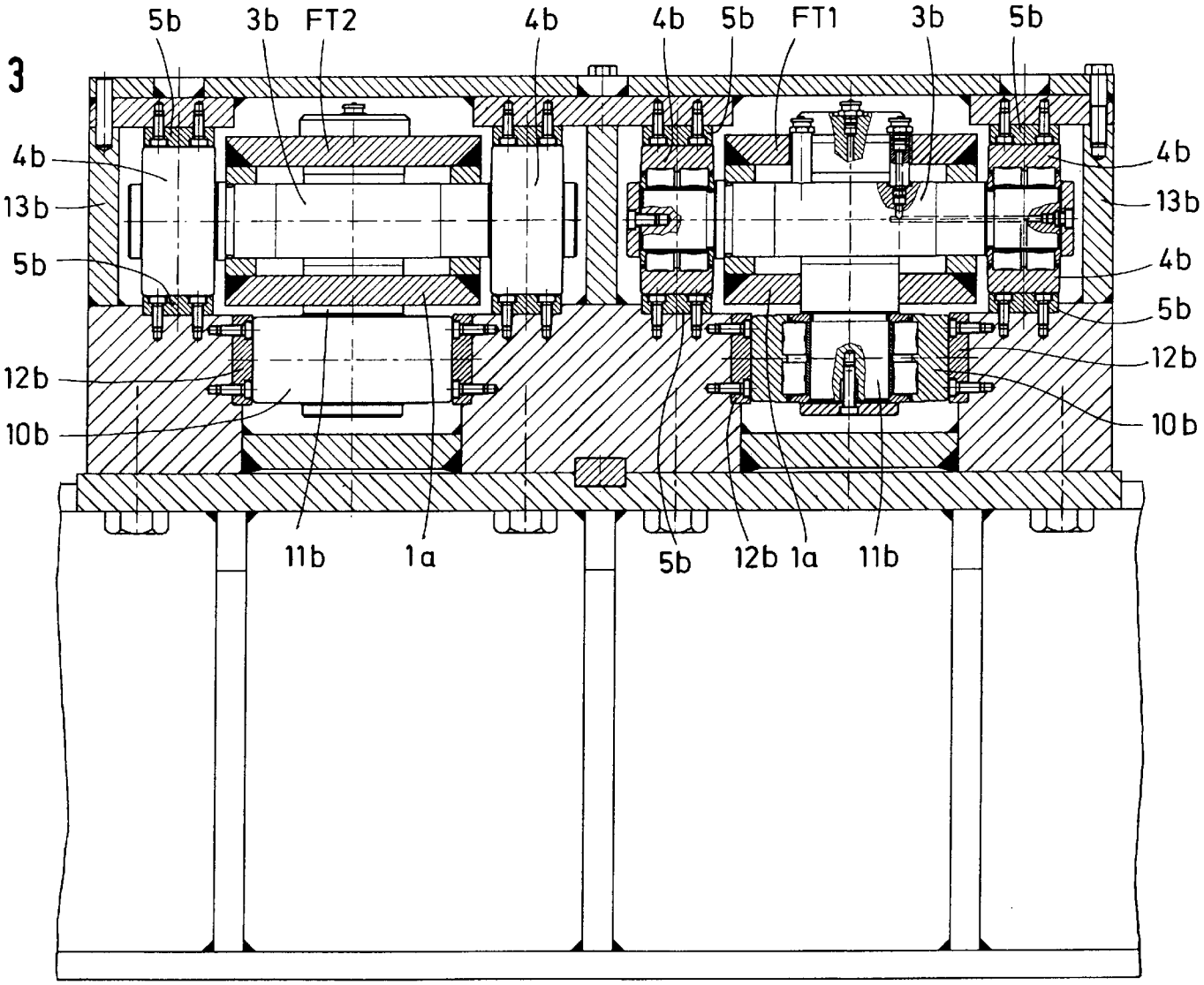
FIG. 3 is a sectional view taken along sectional line A—A in FIG. 1.

As illustrated in FIG. 1, a guide crosshead FT 1 is formed by a bridge-shaped support member; this guide crosshead FT 1 is reinforced against bending in the middle portion 1*c* by a box-shaped section and rests with its end portions 1*a* and 1*b* on the support frame 6 of the roller conveyor, wherein a pair of rollers 4*a* and 4*b*, respectively, is supported in the end portions 1*a*, 1*b*. Arranged on the box-shaped middle portion 1*c* is the support piece 7*a* of two support pieces 7*a*, 7*b*, for the linear slide member 8*a* of the two linear slide members 8*a*, 8*b*. The linear sliding members 8*a* and 8*b* are screwed with a fixed/loose bearing connection on shearing bolts 9 which are placed in the support pieces 7*a* and 7*b*, respectively. Not illustrated in FIG. 1 is the guide crosshead FT 2 which extends parallel adjacent to and behind the guide crosshead FT 1 and supports the linear sliding member 8*b* with the support elements 7*b* and 9. As can be seen in FIG. 3, the guide crosshead FT 2 extends parallel and closely adjacent to the guide crosshead FT 1.

The pairs of rollers 4*a* and 4*b* at the two end portions 1*a*, 1*b* of the guide crossheads FT 1 and FT 2, respectively, are supported on bearing bolts 3*a* and 3*b* and are guided at the top and the bottom in roller tables 5*a* and 5*b*. A vertical roller 10*a* or 10*b* each is mounted underneath the end portions 1*a*, 1*b* in a bearing bolt 11*a* or 11*b* and is guided in roller tables 12*a* and 12*b*, respectively, arranged on both sides. As shown in FIG. 3, these roller tables 5*a*, 5*b* and 12*a*, 12*b* are arranged in a closed support box 13*a* or 13*b* which rests on the support frame 6 of the roller conveyor and is screwed to the support frame 6.

Figure 2:
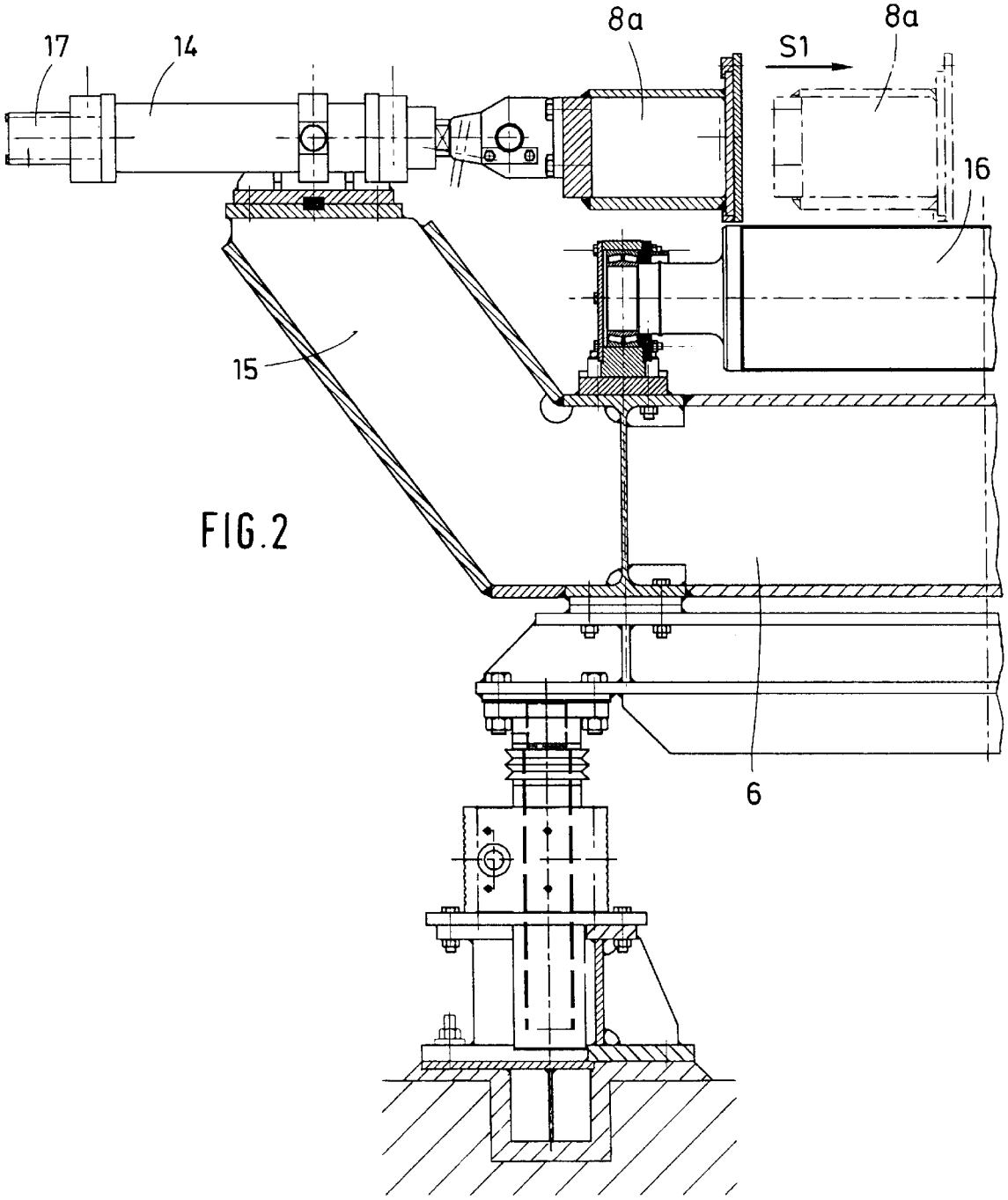
FIG. 2 is a partial sectional view corresponding to FIG. 1 of the shifting device in the area of the drive of a linear sliding member.

The guide crossheads FT 1 and FT 2 together with the linear sliding members 8*a* and 8*b* are displaced in the direction of the arrows S1 and S2 from their positions shown in solid lines into the positions in dash-dot lines by means of pushing piston units, wherein the pushing piston unit 14 provided for the linear sliding member 8*a* is illustrated in FIG. 2. The pushing piston unit 14 is placed on a cantilever projection 15 arranged laterally at the support frame 6 of the roller conveyor 16 and is hinged to the rear side of the guide crosshead which is not shown in this Figure. The positioning shifting movement is controlled through a control unit 17 arranged on the rear side of the pushing piston unit 14.

As is apparent from FIG. 1 in conjunction with FIG. 3, the guide crossheads FT 1 and FT 2 arranged in pairs next to each other and guided in the roller tables 5*a*, 5*b* and 12*a*, 12*b* arranged on both sides of the roller conveyor on the support frame 6 thereof can be moved back and forth and positioned by means of pushing piston units 14 in the direction of arrows S1 and S2. As illustrated, the rollers 4*a*, 4*b* of the guide crosshead FT 1 shown in FIG. 1 are moved out of the position shown in solid lines on the left hand side of the drawing into the position shown in broken lines on the right hand side of the drawing. A corresponding shifting movement in the opposite direction can be controlled with respect to the adjacent guide crosshead FT 2, as is apparent from FIG. 3.

Since the drive units of the guide crossheads FT1 and FT2 and also the roller tables 5*a*, 5*b*; 12*a*, 12*b* for the rollers 4*a*, 4*b* and 10*a*, 10*b* are rigidly connected to the support frame of the roller conveyor, the complete shifting device can be vertically lifted and lowered by means of a lifting unit 18 together with the roller conveyor 16 and the support frame 6 thereof, as can be seen in FIG. 2.

While specific embodiments of the invention have been shown and described in detail to illustrate the inventive principles, it will be understood that the invention may be embodied otherwise without departing from such principles.

I claim:

1. A shifting device for rolling stock placed on a roller conveyor, the shifting device comprising a pair of linear shifting members mounted so as to be shiftable toward each other and away from each other transversely of a conveying direction of the roller conveyor and above a conveying plane of the roller conveyor, guide crossheads supporting the linear sliding members, wherein the guide crossheads are supported on rollers, and stationary drive units arranged outside of the roller conveyor for driving the guide crossheads parallel to rollers of the roller conveyor and between the rollers of the roller conveyor, further comprising roller tables for guiding the rollers supporting the guide crossheads, wherein the rollers for supporting the guide crossheads are mounted in end portions of the guide crossheads, and wherein the roller tables are arranged on both sides of the roller conveyor and are connected to support frames of the roller conveyor.

2. The shifting device according to claim 1, wherein the drive units for the linear sliding members are comprised of positionable pushing piston units mounted laterally of and on the support frame of the roller conveyor and hinged to a rear side of the linear pushing members.

3. The shifting device according to claim 1, wherein each guide crosshead has between the two end portions thereof a box-shaped reinforcing section.

4. The shifting device according to claim 1, with pairs of guide crossheads arranged parallel next to each other for each of the linear sliding members, wherein the rollers supporting the end portions of each guide crosshead include a pair of rollers whose rollers are arranged on both sides of the guide crosshead and are guided on two roller tables extending parallel to each other, and a vertical roll mounted underneath the guide crosshead and guided in additional the roller tables.

5. The shifting device according to claim 4, wherein the roller tables guiding the pair of rollers and the vertical roller are mounted in a closed support box, wherein the roller tables are arranged in pairs horizontally above and below the pair of rollers and the vertical roller.

6. The shifting device according to claim 5, wherein the support box is placed on and screwed onto the support frame of the roller conveyor.

7. The shifting device according to claim 1, wherein the linear sliding members are screwed in a fixed/loose bearing connection on shearing bolts placed in the guide crosshead.

* * * * *